US005707217A

United States Patent [19]

Loeffler

[11] Patent Number: 5,707,217

[45] Date of Patent: Jan. 13, 1998

[54] PRESSURE TRANSFER MODULES

[75] Inventor: Herbert H. Loeffler, Arlington, Mass.

[73] Assignee: Vaughn Thermal Corporation, Salisbury, Mass.

[21] Appl. No.: 659,626

[22] Filed: Jun. 6, 1996

[51] Int. Cl.[6] ..... F04B 17/00

[52] U.S. Cl. ..... 417/339; 417/343; 417/393; 417/395; 417/534; 92/140

[58] Field of Search ..... 417/339, 343, 417/392, 393, 394, 395, 534; 92/64, 140

[56] References Cited

U.S. PATENT DOCUMENTS

| | | | |
|---|---|---|---|
| 1,920,014 | 7/1933 | Horton et al. | 417/393 |
| 3,630,642 | 12/1971 | Osterman | 417/395 |
| 3,652,187 | 3/1972 | Loeffler et al. | 417/393 |
| 4,083,186 | 4/1978 | Jackson, Sr. | 417/339 |
| 4,385,869 | 5/1983 | Omata | 417/393 |
| 4,559,866 | 12/1985 | Brenner | 92/64 |

OTHER PUBLICATIONS

Advertising Supplement for Wilden Pumps from Catalog File Section of Thomas Register 1995, pp. 11461 to 11464 inclusive.

"Pumps, Diaphragm", a listing manufacturers in Thomas Register 1995, pp. 25737/PUM to 25742/PUM inclusive.

Catalog M37B for Haskell Air Driven Amplifiers, 1983 of Haskell, Inc., Burbank, Calif., pp. 1–3.

Catalog TSE7915–83 for Air Driven Hydraulic Pumps etc. of Jun., 1983 of Teledyne Sprague Engineering, Gardena, California, pp. 1–2.

*Primary Examiner*—Charles G. Freay

*Attorney, Agent, or Firm*—Lappin & Kusmer LLP

[57] ABSTRACT

The invention comprises an improved pressure transfer module having, in one embodiment, two double-diaphragm pumps each having its diaphragms connected to one another by a respective drive shaft for reciprocating motion. Spool valve assemblies are mounted directly on the connecting shafts of each pump and arranged to maintain the operation of the two diaphragms of the pumps 90° out of phase in that each such assembly constitutes pressurized water control valves for the other pump. The two pumps are mounted with the drive shafts at 90° to one another, and arranged to pump in sequence so that a complete pumping cycle comprises four pumping strokes, one every 90°. To insure reversal of motion of the shafts in proper phase, the invention includes either two, meshed square cams and cam surfaces formed on respective shafts connecting the pumping surfaces, or a floating crankshaft with each end pivoted in one of the connecting shafts.

13 Claims, 7 Drawing Sheets

PRESSURE TRANSFER MODULES

This invention relates to an improved fluid-pressure transfer module (PTM), and more particularly to pressure transfer modules particularly useful with unpressurized fluid reservoirs.

BACKGROUND OF THE INVENTION

Modules that utilize the energy of incoming cold water from a pressurized water supply in order to pump warmed water out of a reservoir at a similar volume and pressure, are known as pressure transfer modules and are particularly useful for use with unpressurized reservoirs. For reasons of size and economy, pressure transfer module designs employing two opposed cylinders and two pistons connected with a common shaft have been suggested. Among the patents that describe such pressure transfer modules are U.S. Pat. No. 4,437,484 to Laing, U.S. Pat. No. Re 33,222 to Zebuhr and U.S. Pat. No. 4,867,654 to Zebuhr.

The devices described and claimed in such Zebuhr patents require a very large number of movable parts, many of which are quite small, relatively delicate, and expensive to make and assemble into a finished PTM. The large number of moving parts submerged continuously in a hostile environment of a municipal water supply with problems of particulates, corrosives, scale and biological fouling renders PTMs with a large number of submerged parts vulnerable to breakdown and short operating life.

In those prior art PTMs, valving is provided that uses the motion of the piston assembly to stress springs which, at a predetermined position are released and, through a linkage, operate the cold water valves, reversing the incoming cold water flow. Stressing such springs consumes energy, and releasing the springs results in high stresses and high impact often with adverse effects on life of the springs and coupled parts. This valving of the cold water flow serves to reverse the piston movement at the end of each piston stroke, thereby causing a momentary pressure drop or pulse in the output line. The use of a compliant linkage to couple the pistons improves, but does not eliminate, the pulsing. Lastly, because the spring-type PTM is a bi-stable over-center mechanism, it is inherently inaccurate in the position at which the piston assembly shifts. In practice then, such prior art PTMs have been found to require improvement particularly in terms of increased service life and reduction of pressure drop pulsing at the pumped output of the system.

OBJECTS OF THE INVENTION

A principal object of the present invention is to therefore provide an improved PTM that minimizes many of these problems inherent in the prior art. Other objects of the present invention are to provide such a PTM in which many small critical parts and highly stressed valve linkage mechanisms characteristic of the prior art have been eliminated; to provide such a PTM that can be produced at a reduction in cost and an increase in reliability; to provide such a PTM that employs only two moving parts (not including check valves); to provide such a PTM that has four motor-and-pump assemblies arranged so that a complete pumping cycle has four pumping strokes, insuring substantial reduction in pulsing of the output flow from the PTM; to provide such a PTM in which the valving cannot get out of adjustment or phase; to provide such a PTM in which four reciprocating motions arranged in two opposed pairs is kept in sequential phase, and to provide such a PTM that is less fragile than the prior art PTMs, yet yields a smoother output.

SUMMARY OF THE INVENTION

To these ends, the present invention comprises an improved pressure transfer module having generally at least two pairs of motor-and-pump assemblages or sets, e.g. two dual diaphragm pumps. Each such assemblage or set in turn is formed of a pair of vessels each of which is divided by a respective movable partition wall or pumping surface into a pair of variable-volume chambers. Each partition wall is sealed so that leakage cannot readily occur around the wall between the variable-volume chambers in the respective vessel. Respective fluid inlet and outlet channels are provided to the variable-volume chambers. Half of the chambers serve as variable-volume pump chambers, and half serve as variable-volume drive chambers. A pair of elongated shafts connect the partition walls to one another and are mounted for reciprocating travel along their respective axes of elongation.

The present invention also includes first valving means for controlling fluid flow from a source of said pressurized fluid to the inlet channels to the drive chambers in such manner as to operate the drive chambers in sequence. The valving means also controls fluid flow from the drive outlet channels. Typically, the pressure transfer module of the present invention is employed with a reservoir in which spent pressurized fluid is treated, as by heating at ambient atmospheric pressure, and the reservoir thus provides a source of fluid to be pumped by the PTM. Second valving means, typically in the form of check valves, are included for providing fluid communication between a source of fluid to be pumped, e.g. the reservoir, and the pump inlet channels of the pump chambers and for permitting fluid flow out through the outlet channels of the pump chambers. Means are included for coupling the two assemblages to one another to form a radial array so that each of the pumps in said array are operable sequentially in a cycle in which each provides an output flow of heated fluid from the pump chambers to an output line substantially during a respective half of the cycle. To this end, the two pairs of vessels are mounted with the drive shafts at 90° to one another and arranged to pump in sequence so that a complete cycle comprises four overlapping pumping strokes, one starting every 90° of the cycle.

The first valving means comprise spool valve assemblies fixed to and movable with respective ones of the connecting shafts of each pair of pump-and-motor assemblages, each such spool valve assembly constituting reversing valves for the other pump-and-motor assemblage. Means are provided to insure that the four opposed reciprocating motions of the pumping surfaces are kept in sequential phase, i.e. each such motion is 90° out of phase with the prior or subsequent motion of an adjacent such pumping surface, whereby the shaft of each of the pump-and-motor assemblages is in motion along its longitudinal axis while the direction of motion of the shaft of the other assemblage reverses. In a preferred embodiment, means are provided for coordinating the motion of the two shafts so that the length of stroke, acceleration and speed of movement are matched. Typically such coordinating means is formed as cam means slidingly linking or coupling the two shafts, such cam means comprising at least one approximately square cam follower and cam surface, the follower and surface being each disposed on a different one of the shafts connecting the pumping surfaces and operated by motion of the shafts. It will be seen that the coordinating means also serves secondarily to keep the operation of the assemblages in properly phased relationship and for insuring the necessary reversals that constitute reciprocating motion of the shafts occur at the end of each stroke. In another embodiment the means for coordinating shaft movement comprises a floating crankshaft having its respective ends pivoted in corresponding ones of the connecting shafts.

In operation, while the shaft in one of the pump-and-motor assemblages is momentarily reversing and providing no driving or pumping forces, the shaft in the other pump-and-motor assemblages drives the system, thereby insuring that at all times, there is a force present to drive at least one of the shafts and governing the valving mechanism for controlling movement of the other of the shafts. Thus, pressure pulsations are reduced, bistable linkages are eliminated, the mechanism is more reliable, no compliant linkage between pumping surfaces is needed, there is no "dead" zone and no energy needs be stored to operate valving as is typical of prior art pressure transfer modules.

One embodiment of the invention, the pumping surfaces of the pump-and-motor assemblages are provided as flexible diaphragms, but in another embodiment the pump-and-motor assemblages are formed as cylinder/piston combinations.

The foregoing objects of the present invention will in part be obvious and will in part appear hereinafter. The invention accordingly comprises the apparatus possessing the construction and arrangement of parts exemplified in the following detailed disclosure, and the method comprising the several steps and the relation and order of one or more of such steps with respect to the others, the scope of the application of which will be indicated in the claims.

For a fuller understanding of the nature and objects of the present invention, reference should be had to the following detailed description taken in connection with the drawings wherein like numerals denote like parts.

DETAILED DESCRIPTION

Figure 1:
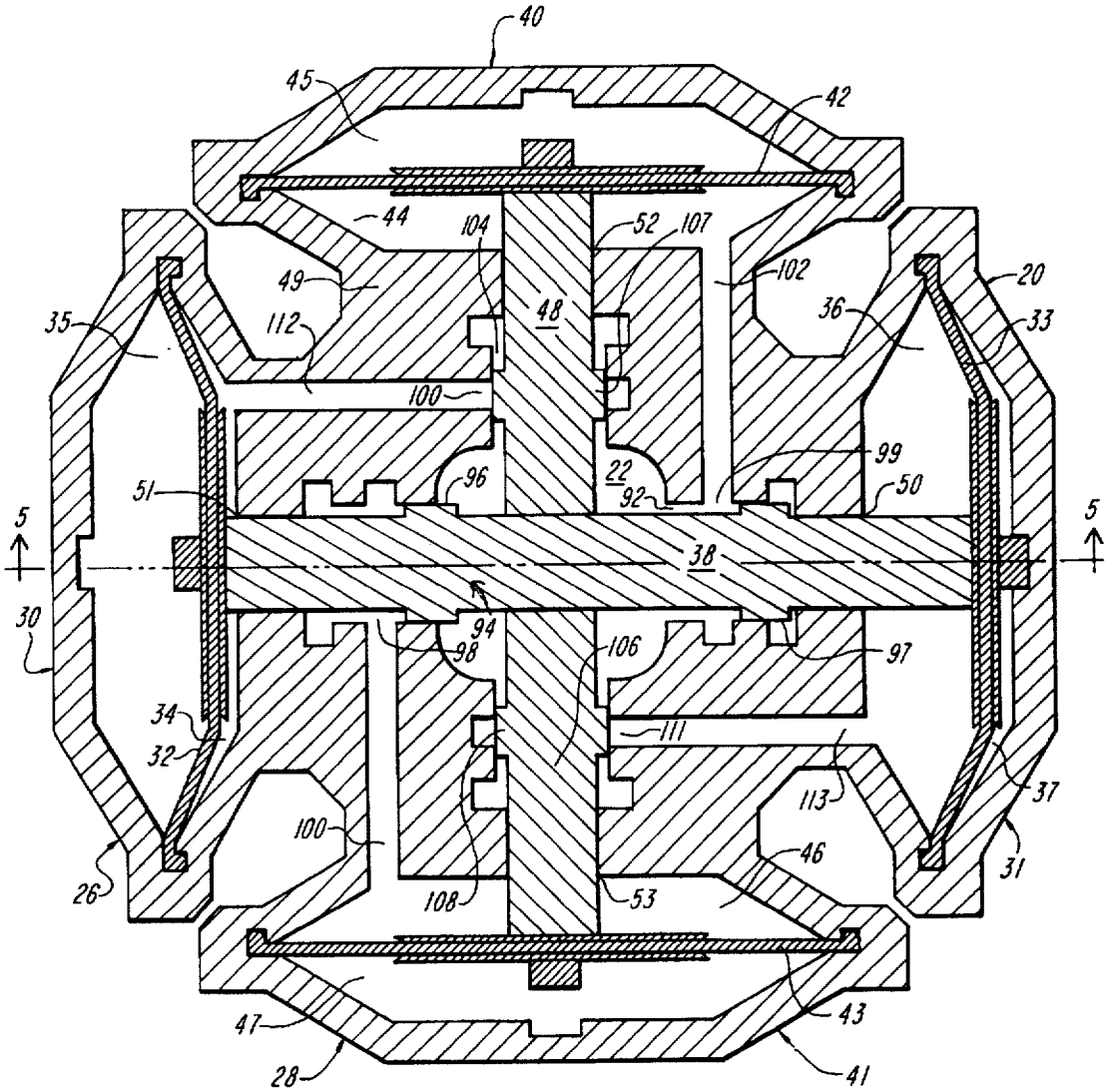
FIG. 1 is a cross-sectional view of a PTM that embodies the principles of the present invention, showing the position of the elements thereof at the conclusion of a first stroke of the device in a cycle of four strokes.

Shown in the drawing is a fluid-driven pump or PTM 20 embodying the principles of the present invention and characterized in having a cold-water inlet line 22 and a cold water outlet line 24. As will be described in detail hereinafter, when inlet line 22 is connected to a source of pressurized fluid, such as an inlet water line and cold-water outlet line 24 is vented to an unpressurized reservoir, such as the tank (not shown) of an unpressurized water heater, the flow of water across this pressure difference provides the power that drives PTM 20.

Particularly as shown in FIGS. 1–6 inclusive, PTM 20 includes first and second pump-and-motor assemblages or sets 26 and 28. In the embodiment shown, pump-and-motor set 26 is in the form of a dual-diaphragm pump formed of first and second enclosed vessels 30 and 31, each enclosing a respective thin, flexible, partition wall or diaphragm 32 and 33, the periphery of each of which is sealed to the interior wall of the corresponding vessel. Diaphragm 32 thus divides the interior of vessel 30 into first and second chambers 34 and 35, and diaphragm 33 similarly divides the interior of vessel 31 into third and fourth chambers 36 and 37. The centers of diaphragms 32 and 33 are rigidly connected to one another by connecting shaft 38 so the diaphragms are movable in tandem along with motion of shaft 38 along its longitudinal axis. Similarly, pump-and-motor set 28 is another dual-diaphragm pump comprising third and fourth enclosed vessels 40 and 41, each enclosing a respective thin, flexible, partition wall or diaphragm 42 and 43, the periphery of each of which being sealed to the interior wall of the corresponding vessel. Diaphragms 42 and 43 respectively divides the interiors of vessel 40 and 41 into corresponding fifth and sixth chambers 44 and 45, and seventh and eighth chambers 46 and 47. The centers of diaphragms 42 and 43 are rigidly connected to one another by connecting elongated shaft 48 so the diaphragms are movable along the longitudinal axis of shaft 48 in tandem. Shafts 38 and 48 are arranged in a radial array in which their respective long axes are substantially perpendicular to one another and the means are provided for mounting the shafts to constrain their motion to movement along their respective longitudinal axes in a common plane or in planes parallel to and spaced apart from one another To this end, shafts 38 and 48 are disposed in frame 49 which is shaped to provide constraining guide channels 50 and 51 in which shaft 38 is slidably mounted and similar channels 52 and 53 in which shaft 48 is slidably mounted.

In the embodiment shown in FIGS. 1–6 inclusive, chambers 34, 36, 44 and 46 are considered drive chambers in that, in order to drive the PTM, cold water at line pressure from inlet line 22 is admitted sequentially into these chambers by valving means described hereinafter, the water being subsequently vented through cold water outlet line 24, typically into an unpressurized reservoir (not shown) where it can be treated, e.g. as by heating, irradiating, chlorinating or the like. Chambers 35, 37, 45 and 47 are considered to be pump chambers that alternately draw in treated fluid to be pumped, such as heated water from the unpressurized reservoir and expel or pump the heated water into hot-water output line 54. Because, in a preferred embodiment, PTM 20 is intended to operate submerged in the unpressurized reservoir, the hot water access to the pump chambers is provided directly from the reservoir through open frame 49 and check valves hereinafter identified, but it will be understood that, if desired, frame 49 can be provided with a common manifold that combines the check valves into a single treated-water inlet port.

The present invention includes means for controlling fluid communication from pressurized or cold water inlet 22 sequentially through pressurized or cold water inlet ports respectively connected to drive chambers 34, 36, 44 and 46 and through which ports pressurized water from inlet line 22 is admitted, and alternately out of those ports from the drive chambers to cold water outlet line 24 for release into the unpressurized reservoir, all in a manner such that the four drive chambers are pressurized cyclically, i.e. in a sequence, to operate the four pump chambers in the same cycle. To this end, the means for controlling fluid communication in the embodiment shown in FIGS. 1–6 inclusive comprises a valving system which will be described in further detail hereinafter. As shown particularly in FIG. 6, the means for controlling fluid communication also includes means for feeding hot water from the heated reservoir to pump chambers 35, 37, 45 and 47 sequentially through respective inlet check valves 55, 56, 57 and 58 which serve to prevent flow out of the pump chambers back into the reservoir, and from those respective pump chambers through outlet check valves 59, 60, 61 and 62 to hot water pump outlet line 54, the latter group of check valves serving to prevent back-flow into the respective pump chambers. Each of check valves 59, 60, 61 and 62 is connected as a feed to hot water output line 54 through manifold 63 in frame 49.

Figure 7A:
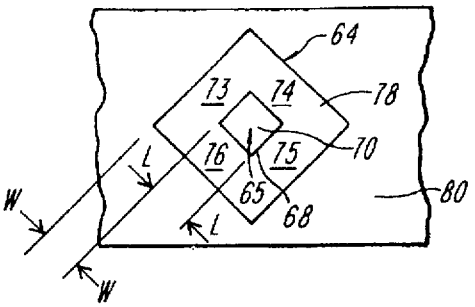
FIG. 7A is a schematic plan view of a cam and cam follower useful in a reversing system for the embodiment of FIG. 1.
Figure 7B:
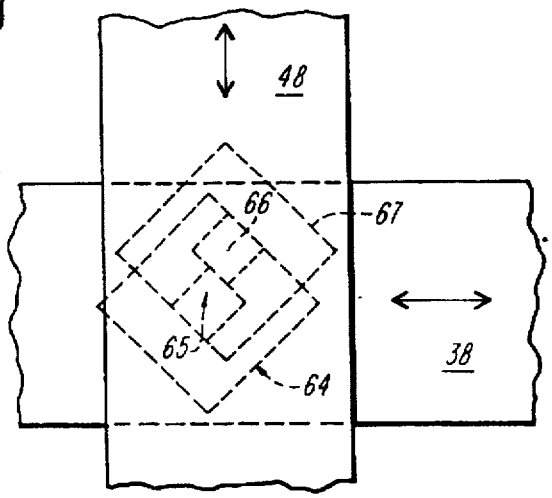
FIG. 7B is a fragmentary, schematic plan view showing the relation of the shafts of the embodiment of FIG. 1 to a pair of the cams and cam followers of FIG. 7A, shown in phantom.
Figure 7C:
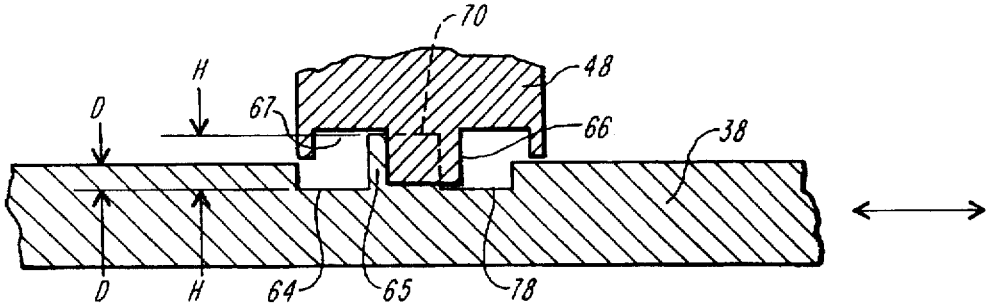
FIG. 7C is a cross-sectional, elevational view, partially in fragment, of the shafts and the cams and cam followers of the embodiment of FIG. 7B.

Because fluctuations in line pressure of the pressurized fluid introduced into the drive chambers may cause sets 26 and 28 to provide different stroke travel lengths, acceleration (or deceleration) and/or velocity, means are preferably provided for coordinating the shaft motions. One embodiment of such means for coordinating shaft motion is provided, as shown particularly in FIGS. 7A, 7B and 7C, in the form of cam 64 and corresponding cam follower 65, and cam 66 and corresponding cam follower 67, the latter being identical to respective cam 64 and follower 65, hence only cam 64 and follower 65 will be described in detail. Cam follower 65 is in the form of peg 68 having a substantially square cross-section and planar top surface 70. Peg 68 is contiguously surrounded by cam 64 configured as a continuous moat formed as four equal-length, straight cam slots 73, 74, 75 and 76 having invariant rectangular cross-sections, the bottom of each of the cam slots being common planar surface 78 parallel to surface 70 of peg 68. The width (shown as W—W in FIG. 7A) of each cam slot, taken parallel to surface 78, is slightly greater than the length (shown as L—L in FIG. 7A) of a side of peg 68, to allow sufficient clearance so that so that the corresponding cam follower 67 can slide in the cam slots. The height (shown as H—H in FIG. 7C) of peg 68 is such that it is slightly greater than twice the depth (shown as D—D in FIG. 7C)of the cam slots both taken perpendicular to surface 78.

Cam follower 65 and its surrounding cam 64 are typically mounted on or formed, as by machining, molding or the like, in flat surface 80 of shaft 38 so as to be fixed to the shaft and constrained for movement together with the shaft. One of the diagonals between opposite extreme corners of cam 64 is collinear with the longitudinal axis of shaft 34, the dimension of that diagonal (measured from the center lines of the cam slots) being substantially equal to the distance required for shaft 34 to move from one extreme position of its travel to the opposite extreme. Cam follower 66 and its surrounding cam 67 are mounted on or machined into flat surface 82 of shaft 48 in similar manner. Shaft 38 is positioned so that flat surface 80 is parallel and slightly spaced-apart from surface 82 of shaft 48, with cam follower 66 extending from shaft 38 into a slot in cam 67 on surface 82. Similarly, cam follower 62 extends from shaft 48 into a slot in cam 60 on surface 80. It will be seen that in the embodiment shown in FIG. 4, thus two identical approximately square cams and cam followers are linked or meshed with one another.

In operation, as shaft 38 moves in one direction along its constrained path its motion is transmitted to shaft 48 through the camming mechanism in that cam follower 64 slidably engages a corresponding first cam slot in meshed cam 67 and cam follower 66 slidably engages a similar slot in its meshed cam 64, causing shaft 48 to be driven in one direction perpendicularly to shaft 38 until a corner of the cams is reached, at which point the cam followers engage the next cam slots disposed at 90° to the first cam slots, driving shaft 48 in an opposite direction. It can be seen that the sharp corners of the cams can result in instant reversal, so the motion of the shafts can be described in a time/distance plot as a substantially square wave.. Rounding the corners of the cams or otherwise shaping the paths will result in any particular desired motion of the shafts, and particularly importantly can introduce a slight delay in the reversal of the shafts, for example, altering the square wave plot so that the waveform is more trapezoidal. It will also be apparent that the surfaces of the cams and cam followers are subjected to very low forces because the shafts are driven at the same speeds by the same water pressure, and hence need not be made of very high strength materials. It will be apparent that the coordinating means described serves to control the length, speed and acceleration or deceleration of shaft motion, simply by appropriate dimensioning and shaping of the cam and follower surfaces.

It will also be apparent that although a preferred camming mechanism for coordinating shaft motion has been described in terms of a pair of meshed cams and cam followers, only a single cam mounted on one of the shafts and a cam follower mounted on the other of the shafts can be employed to impart similar constraint on shaft motions. Also, while the mechanism of FIG. 7 has been described in terms of a continuous moat forming a cam extending around each cam follower, the corners of each such cam at the diagonals perpendicular to the axis of elongation of the corresponding shaft can be truncated, but in such case, a meshed dual cam and cam follower arrangement should be employed. The coordinating means thus described not only serves to coordinate shaft motions but also contributes mechanically to control timing of the shaft reversals and to insure that the shafts cannot "hang up" at either extreme position of their travel.

Figure 8:
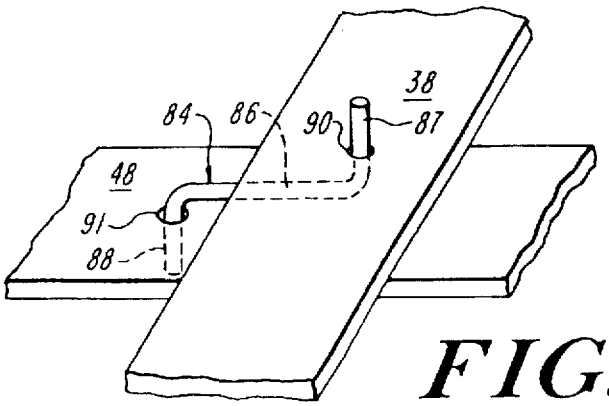
FIG. 8 is a simplified perspective diagram, partially in fragment and in phantom, of an alternative reversing mechanism useful in the embodiment of FIG. 1.

Other known types of coordinating mechanisms can also be employed, e.g. a crankshaft with fixed bearings and connecting rods to reciprocating members, a crankshaft with fixed bearings and with scotch yokes on reciprocating members, a rotary cam with followers on reciprocating members, a crankshaft without fixed bearings (a floating crankshaft), and the like. The mechanism shown in FIG. 8 is a simple example of such a floating crankshaft and simply comprises crankshaft 84 formed of a central linear arm 86 having two upstanding pivot fingers 87 and 88 extending from opposite ends of arm 86 in opposite directions perpendicular to the axis of elongation of arm 86. Pivot finger 87 extends into pivot hole 90 provided in a central position on shaft 38 while pivot finger 88 is similarly rotatably mounted in pivot hole 91 in central position in shaft 48. It will be seen that the motion of one shaft is thereby transmitted to the other shaft in a manner that can be shown as a substantially sinusoidal plot in a time/distance graph of the motions of the shafts. The mechanism shown in FIG. 7 is, however, preferred for purposes of the present invention inasmuch as it has the least number of parts, and all parts are fixed to a corresponding reciprocating shaft.

Importantly, the present invention provides valving means that essentially controls the timing of the driving of the shafts by the pressure of the cold water inlet flow, the valving for a first of the vessel pairs in which the partition walls are coupled through a first of the shafts, being connected for operation by the other or second shaft which connects the partition walls of the second vessel pair. Similarly, the valving for the second vessel pair is connected mounted for operation by the first shaft. To this end, the valving means of the present invention comprises a pair of spool-type valve assemblies for controlling the flow of relatively high pressure fluid from cold water inlet line 22 to respective drive inlet ports in the drive chambers so that the high pressure fluid is admitted to each one of the drive chambers in sequence while the fluid in each other of the drive chambers is sequentially dropped to a relatively low pressure by permitting evacuation of said fluid from the each other of the drive chambers to the reservoir. In the embodiment shown in detail particularly in FIG. 1, one such valve assembly is a set of valves comprising a valve body chamber formed in frame 49 as a substantially cylindrical, hollow valve bore 92 in which spool 94 is sealingly and slidingly disposed. Spool 94 is preferably provided as a pair of transversely extending circular lands or seals 96 and 97 fixed to or formed integrally with shaft 38. Seals 96 and 97 are positioned in spaced apart relation from one another along an intermediate portion of shaft 38 at points equidistant from the center of shaft 38. Seals 96 and 97 are slidingly sealed to the internal wall of bore 92 as by elastomeric O-rings or the like (not shown). Formed in the internal wall of bore 92 are a pair of valve apertures 98 and 99 providing fluid communication with respective conduits 100 and 102. Conduit 100 constitutes a cold water inlet line connected to the cold water inlet port to drive chamber 46; similarly, conduit 102 is employed as the cold water inlet line to drive chamber 44. Valve apertures 98 and 99 are disposed along the inner surface of bore 92 in radially opposite directions and spaced from one another along the axis of bore 92 by substantially the same distance as the spacing between seals 96 and 97 at respective points equidistant from the point of intersection of shafts 38 and 48.

A second valve assembly is provided comprising a valve body chamber formed as a substantially cylindrical, hollow valve bore 104 in which spool 106 is sealingly and slidingly disposed. Spool 106 comprises another pair of transversely extending circular lands or seals 107 and 108 formed integrally with shaft 48, being spaced apart from one another along an intermediate portion of shaft 48 at points equidistant from the center of shaft 48. Seals 107 and 108 are slidingly sealed to the internal wall of bore 104 as by elastomeric O-rings or the like (not shown). A pair of valve ports or apertures 110 and 111 providing fluid communication with respective conduits 112 and 113 are formed in frame 49, the latter two conduits constituting cold water inlet lines connected to respective drive chamber 34 and 36. Valve apertures 110 and 111 are formed in the inner surface of bore 104 in radially opposite directions, being spaced from one another along the axis of bore 104 by substantially the same distance as the spacing between seals 107 and 108 at respective points equidistant from the point of intersection of shafts 38 and 48. In all cases, the length of the seals along the axis of its corresponding shaft is substantially greater than the dimension of the corresponding aperture along the axis of the respective bore.

Thus, seals 96, 97, 107 and 108 and corresponding valve apertures 98, 99, 110 and 111 are dimensioned and positioned so that the valving provided by each shaft occurs approximately when the shaft is at the midpoint of its travel. Thus the motion of one shaft opens and closes the valves that control the reversal of motion of the other shaft. For example, as shaft 38 moves in the midst of its travel, respective seals close the outlet aperture from the unpressurized drive chamber coupled to shaft 48 and simultaneously close the inlet drive aperture to the pressurized drive chamber coupled to shaft 48, and then the inlet aperture to the unpressurized drive chamber coupled to shaft 38 is opened and the outlet aperture of the pressurized chamber coupled to shaft 38 is opened. Thus, for a very brief interval at the end of the stroke of the diaphragms or pistons, determined by the dimensions and location of the seals and valve apertures, one of the drive chambers is momentarily unpressurized so that only one of the two shafts is water pressure driven. It will also be apparent that because the valve assemblies provides fixed positions of the valve apertures and seals, the valve timing cannot get out of adjustment.

In describing the operation of PTM 20, reference will be made to the direction of motion as seen from the drawings, particularly FIGS. 1–4 inclusive, but it is emphasized that the invention is not to be construed as thereby limited to those directions. It will also be understood that because each pair of motor-and-pump assemblages or sets, exemplified by a dual-diaphragm pump, functions so that the partition or diaphragm in one of the assemblages is being driven at one surface in the drive chamber by the force of the pressurized inlet water and the opposite surface of that diaphragm is therefore pumping heated water from the pump chamber, while one surface of the coupled diaphragm in the other of the assemblages is driving the now unpressurized cold water out of the drive chamber and into the reservoir for heating and the opposite surface of that coupled diaphragm is pulling in heated water from the reservoir, the two assemblages operate, in essence, 180° out of phase with one another. The present invention employs two such pairs of assemblages arranged so that the resulting four motor-and-pump systems function sequentially to provide four pumping operations each 90° out of phase with the preceding operation. This desired phased operation is ensured by coupling the two pairs of assemblages together through the camming system or other like mechanism described earlier herein and by arranging to have the valving of the alternating pressurized water supply to each pair of assemblages controlled by the motion of the other pair of assemblages.

Figure 2:
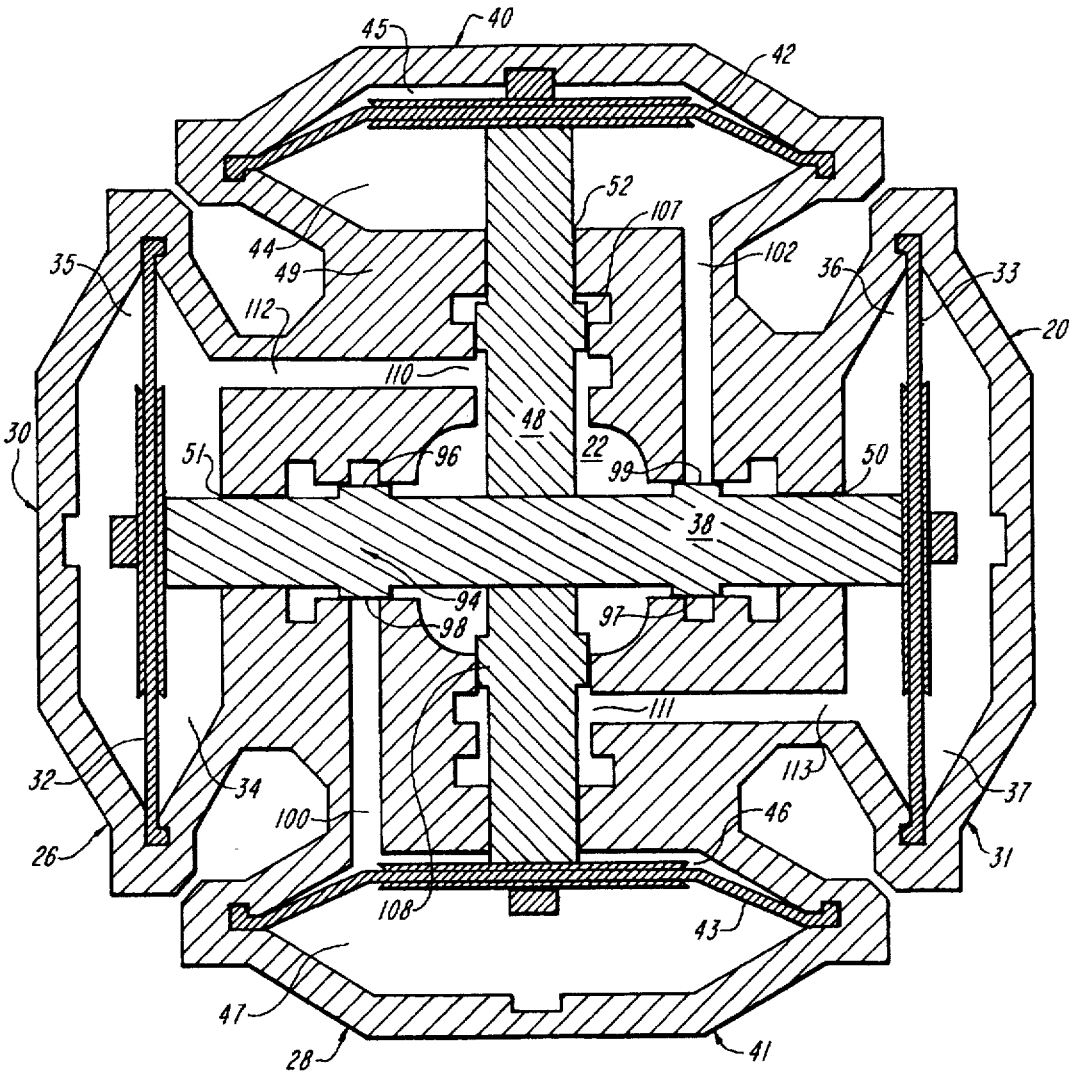
FIG. 2 is a cross-sectional view of the PTM of FIG. 1, showing the position of the elements thereof at the conclusion of the second stroke of the cycle.

One can initially assume that, as shown in FIG. 1, shaft 48 is at the midpoint of its stroke where seals 107 and 108 respectively occlude valve apertures 110 and 111, and shaft 38 is at the extreme right of its travel. As shaft 48 moves upwardly, impelled by the pressure of the cold water flowing from inlet line 22 through valve aperture 99 into drive chamber 44, seals 107 and 108 will also move with shaft 48, opening valve apertures 110 and 111 respectively. Cold water at line pressure then flows from input line 22 through aperture 110 and connecting conduit 112 and into drive chamber 34, exerting pressure against a surface of diaphragm 32 so as to force the latter to move to the left as shown in FIG. 2. This motion of diaphragm 32 serves several functions. First, it axially moves connected shaft 38 to the left. The leftward motion of shaft 38 controls a valving function in that the shaft motion slides seals 96 and 97 so that they occlude respective apertures 98 and 99, arresting and preventing flow of pressurized water into the latter. The motion of diaphragm 32 to the left also causes one surface of coupled diaphragm 33 to exert pressure on cold water remaining in chamber 36, forcing the cold water out of chamber 36 through conduit 113 and opened aperture 111 for delivery to the reservoir where the cold water discharge is to be heated. At the same time, the opposite surface of diaphragm 32 exerts pressure on heated fluid in pump chamber 35, forcing that fluid out through check valve 59 for delivery along channel 53 to hot water line 54. Pumped hot water cannot flow back into the heating reservoir because of check valve 55 at the hot water inlet to pump chamber 35. The motion of diaphragm 33 as shaft 38 moves to the left also draws hot water into pump chamber 37 through check valve 56 while check valve 60 prevents that water from flowing into channel 63. As the coupled diaphragms 32 and 33 move leftwardly, cam follower 64, mounted on shaft 38, moves along the contour of meshed cam 66 which is mounted on shaft 48. When shaft 38 reaches the midpoint of its motion to the left, seals 96 and 97 have moved with shaft 38 to unseal respective apertures 98 and 99, permitting pressurized cold water to enter through aperture 98 and conduit 100 into pump chamber 46 to drive diaphragm 43 and move shaft 48 downwardly.

Figure 3:
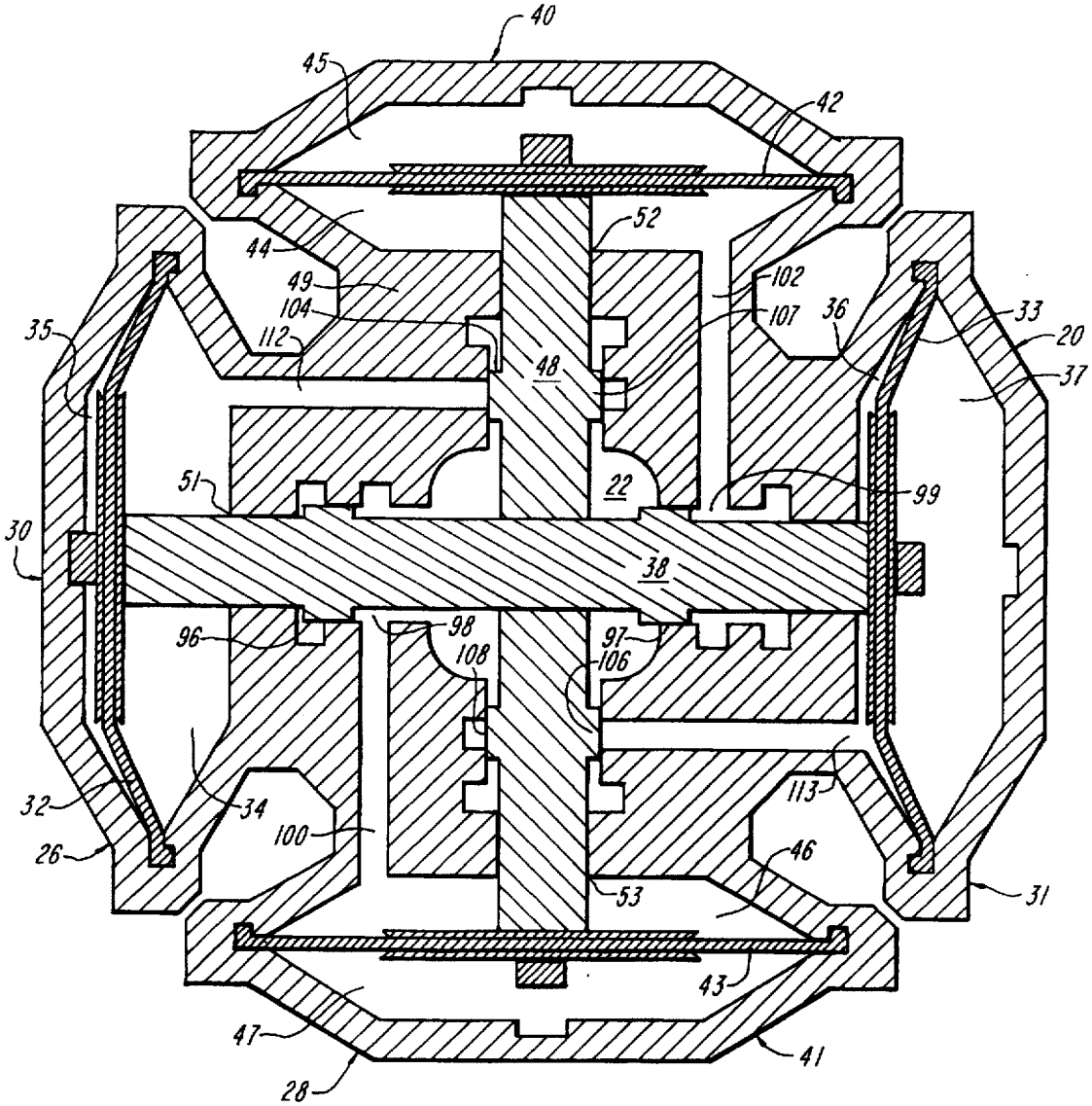
FIG. 3 is a cross-sectional view of the PTM of FIG. 1, showing the position of the elements thereof at the conclusion of the third stroke of the cycle.

When shaft 38 reaches the limit of its travel to the left as shown in FIG. 3, ending the stroke, the introduction of pressurized fluid into drive chamber 36, as described hereinafter, reverses the direction of the motion of shaft 38, and the camming mechanism of cams 64 and 66 and followers 65 and 67 constrain shaft 38 to move to the right. Inasmuch as aperture 98 is unsealed, the downward motion of shaft 48 and the concomitant flexing of diaphragm 42 serves to force spent cold water out of chamber 44 through conduit 102 to the reservoir for subsequent heating, and draw heated water from the reservoir into pump chamber 45. The downward motion of diaphragm 43 serves to pump hot water out of pump chamber 47 through check valve 62 into hot water discharge line 54. As noted above, appropriate check valves prevent backflow of the hot water pumped from chamber 47 and drawn into chamber 45.

Figure 4:
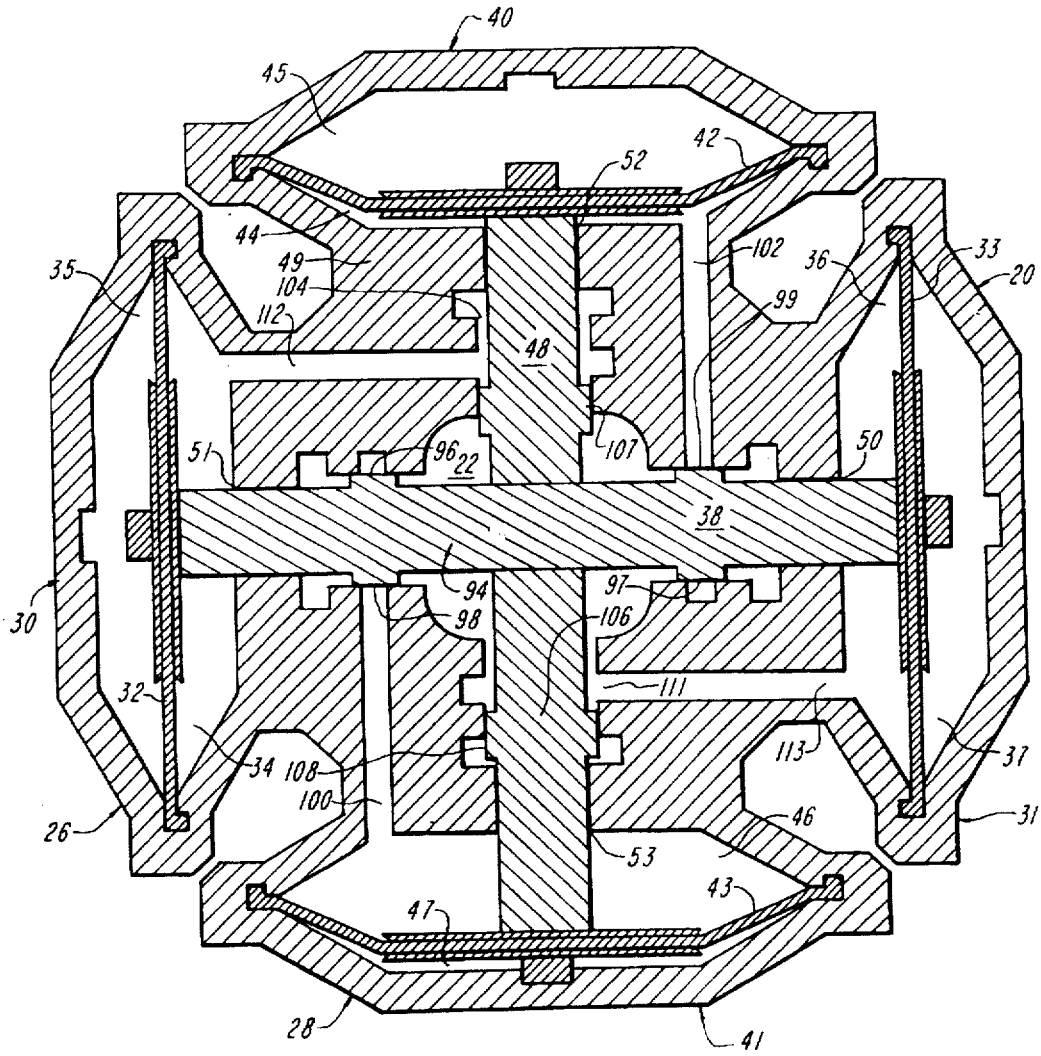
FIG. 4 is a cross-sectional view of the PTM of FIG. 1, showing the position of the elements thereof at the conclusion of the last stroke of the cycle.
Figure 5:
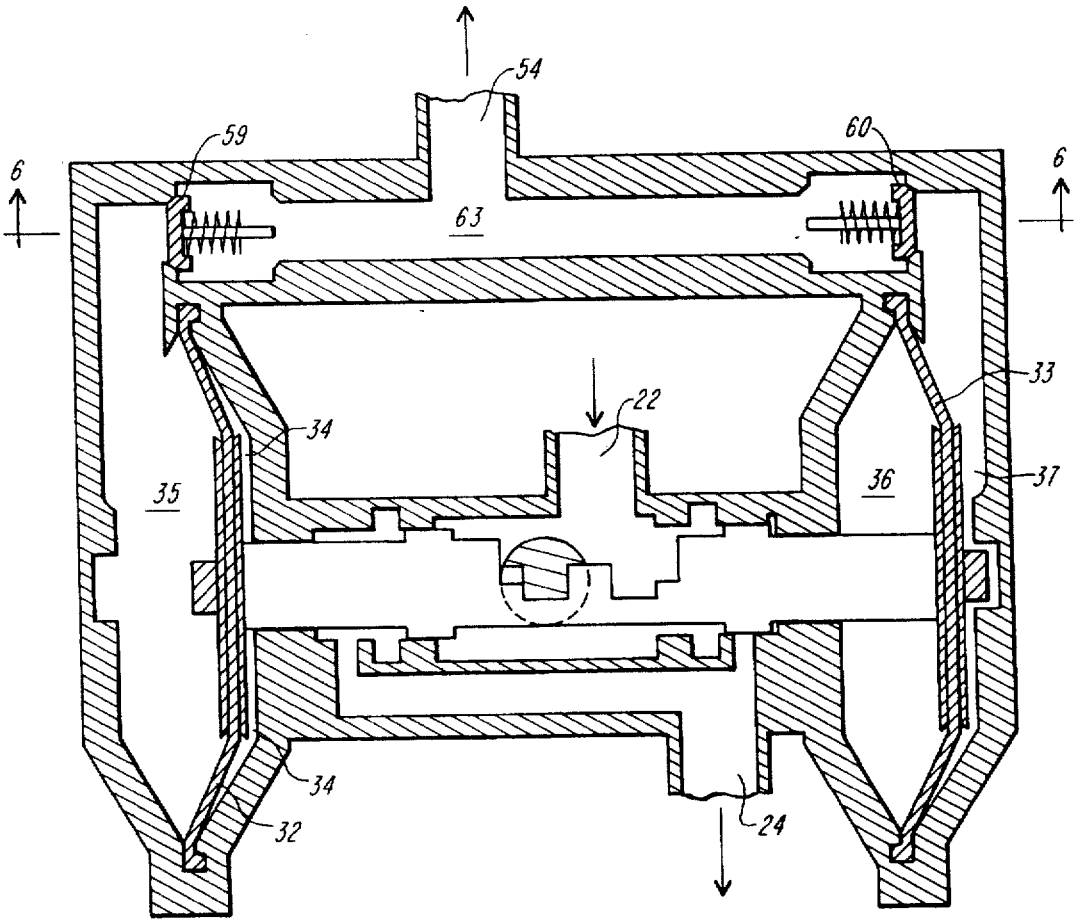
FIG. 5 is a cross-sectional view of the PTM of FIG. 1, taken along the line 5—5 in FIG. 1.
Figure 6:
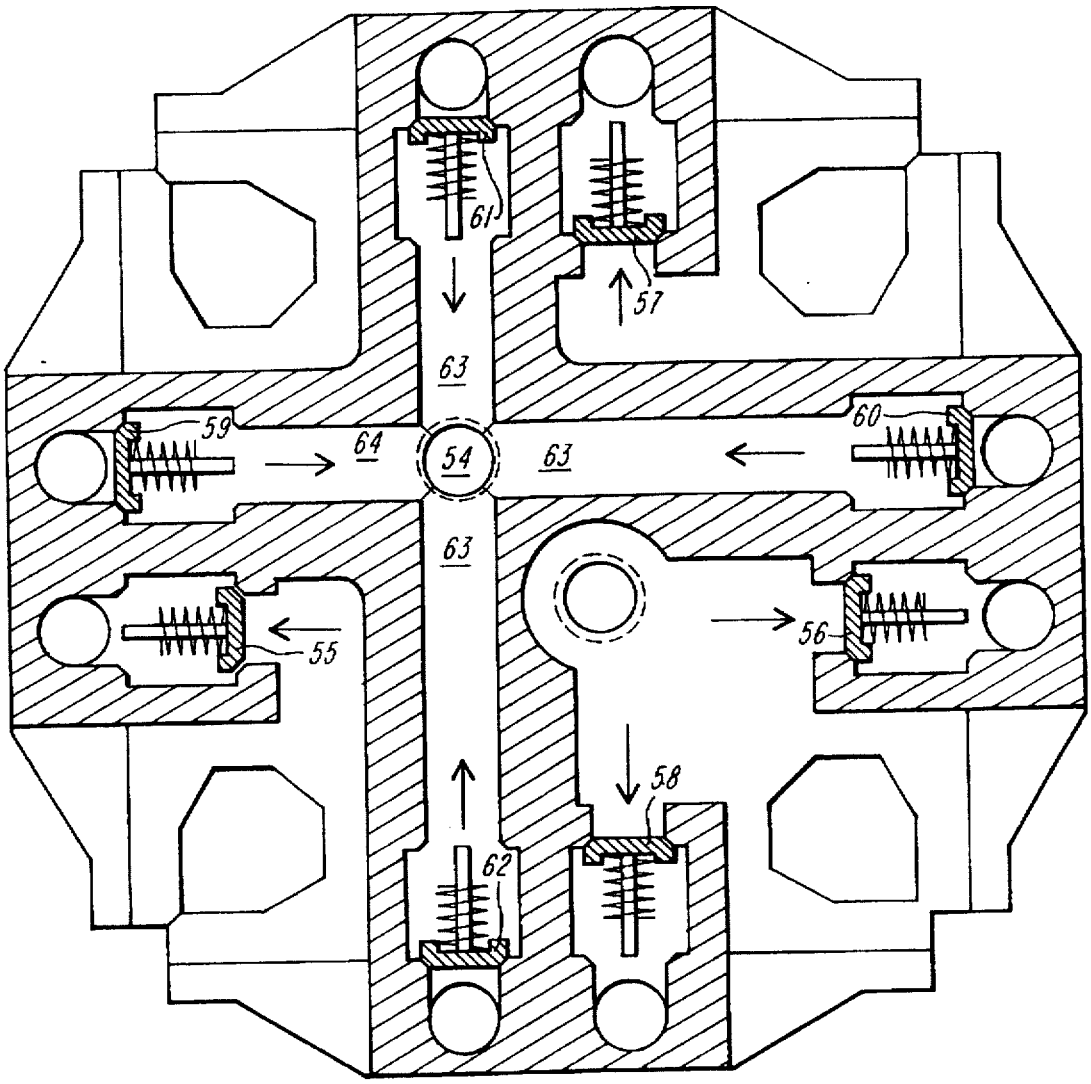
FIG. 6 is another cross-sectional view of the PTM of FIG. 1, taken along the line 6—6 in FIG. 5.

As the coupled diaphragms 42 and 43 move downwardly, the coupled motion of shaft 48 carries seals 107 and 108 past apertures 110 and 11, thereby permitting now unpressurized cold water to flow out of drive chamber 34 to the heating reservoir and pressurized cold water to flow into drive chamber 36 to force shaft 38 to the right, moving seals 96 and 97 to seal respective apertures 98 and 99. Thus inasmuch as diaphragm 42 has reached its limit of motion downwardly as shown in FIG. 4, no pressurized cold water can now flow into pump chamber 44. The rightward motion of shaft 38 serves to flex diaphragms 32 and 33 forcing cold water out of drive chamber 34 and pumping hot water out of pump chamber 37, and serves also to unseal apertures 98 and 99. Cam followers 65 and 66 move along the contour of meshed cams 64 and 67 and guide the subsequent reversal of motion of shaft 48 by the valving operated by shaft 38, as shaft 48 is impelled then downwardly by the introduction of pressured water into drive chamber 46. It will be seen that at this point, the four stroke cycle of the PTM of the present invention has been completed and will continue to the next stroke illustrated in FIG. 1. It will thus be appreciated that at all times during the entire pumping cycle, some pumping of hot water will occur, thus substantially reducing pumping pulsations. It is apparent that because, for much of the cycle, the cold water line pressure simultaneously drives both shafts, and at least one shaft is so driven during the short intervals at the end of the stroke when the other shaft is not driven, the structure of the present invention has eliminated any need for bistable linkages.

Although the PTM as thus described divides each pump-and-motor set into a pump and a drive chamber, it will be appreciated that one such set in each of the respective coupled pairs of such sets can be formed with a pair of pump chambers, the other such set in the coupled pair being formed with a pair of drive chambers. The preferred form, however, of the PTM of the present invention splits each pump-and-motor set into respective pump and drive chambers inasmuch in order to reduce the stress along the shaft and diaphragm assembly. This structure particularly reduces the pressure differential across the diaphragm in each set and thus the sealing requirements for the PTM are not as critical.

Since certain changes may be made in the above apparatus and process without departing from the scope of the invention herein involved, it is intended that all matter contained in the above description or shown in the accompanying drawing shall be interpreted in an illustrative and not in a limiting sense.

What is claimed is:

1. In a pressure transfer module including a first pair of pump means each of said pump means having (1) a corresponding pair of variable-volume pump chambers having respective pump inlet and outlet ports for providing flow of unpressurized fluid from a source thereof into said pump chambers and out to a fluid outlet line, (2) a corresponding pair of variable-volume drive chambers having respective drive inlet and outlet ports for providing flow of a pressurized fluid in and out of said drive chambers, (3) a pair of movable partition walls each respectively separating a corresponding one of said drive chambers from a corresponding one of said pump chambers, and (4) an elongated shaft connecting said partition walls to one another and mounted for reciprocating travel along the axis of elongation of said shaft, said module including first valving means for controlling fluid flow from a source of said pressurized fluid to said drive inlet ports and fluid flow from said drive outlet ports to said reservoir, the improvement wherein said module comprises:

a second pair of said pump means having substantially the same elements (1) through (4) inclusive as set forth hereinbefore, and means for arranging said first and second pairs of pump means to one another to form a radial array in which said first valving means are operable by the shafts of respective pairs of said pump means that each of said pump chambers in said array are operable sequentially in a cycle in which each of said pump chambers provides an output flow of fluid to said output line substantially during a respective, approximately one-half of said cycle.

2. A pressure transfer module as set forth in claim 1 wherein said pump means are disposed in said radial array so that the respective shafts of said pump means are constrained to move along the axes of elongation thereof substantially perpendicular to one another in substantially parallel planes.

3. A pressure transfer module as set forth in claim 1 wherein said first valving means is connected to and driven by said shafts for controlling the flow of fluid in and out of said respective inlet and outlet ports in said drive chambers.

4. A pressure transfer module as set forth in claim 3 wherein said first valving means is constructed and arranged so that reversal of the motion of each shaft is controlled by motion of the other shaft.

5. A pressure transfer module as set forth in claim 3 wherein said first valving means comprises a first valve set operable by the motion of said shaft connecting said partition walls of one of said pump means, for controlling fluid flow of said pressurized fluid into alternate ones of said drive chambers of the other of said pump means, a second valve set operable by the motion of said shaft connecting said partition walls of said other of said pump means, for controlling fluid flow of said pressurized fluid into alternate ones of said drive chambers of said one of said pump means.

6. A pressure transfer module as set forth in claim 3 wherein each of said valve sets is connected to respective ones of said shafts so that operation of said valve sets maintains the operation of each of said pairs of drive chambers at substantially 90° intervals during said cycle.

7. A pressure transfer module as set forth in claim 3 wherein said first valving means comprises a first plurality of valve apertures connected to respective ones said inlet and outlet ports of one pair of said drive chambers in which said partition walls are connected by a first of said shafts, a second plurality of valve apertures connected to respective ones said inlet and outlet ports of the other pair of said drive chambers in which said partition walls are connected by a second of said shafts, first sliding seal means mounted on said first of said shafts for movement therewith in and out of sealing relation to said second plurality of said inlet and outlet ports, and second sliding seal means mounted on said second of said shafts for movement therewith in and out of sealing relation to said first plurality of said inlet and outlet ports.

8. A pressure transfer module as set forth in claim 1 wherein said means for arranging includes means for coordinating the motion of said shafts so as to substantially equalize the speed, acceleration and/or length of the reciprocating travel of the two shafts.

9. A pressure transfer module as set forth in claim 8 wherein said means for coordinating the motion of said shafts comprises at least one cam fixed to one of said shafts and defining a cam surface, and a cam follower fixed to the other of said shafts, said cam follower being in sliding contact with said cam surface so as to constrain motion of said shafts in accordance with the contacting contours of said cam surface and follower.

10. A pressure transfer module as set forth in claim 8 wherein said means for coordinating said shafts comprises a first cam fixed to a first of said shafts and defining a first cam surface, a first cam follower fixed to said first shaft, a second cam fixed to a second of said shafts and defining a second cam surface, a second cam follower fixed to said second shaft, said cams and cam followers being meshed such that said first cam follower is in slidable contact with said second cam surface and said second cam follower is in contact with said first cam surface so as to constrain motion of said shafts in accordance with the contacting contours of said cam surfaces and followers.

11. A pressure transfer module as set forth in claim 8 wherein said means for coordinating said shafts comprises a floating crankshaft having one end pivotably mounted substantially at the midpoint along one of said shafts and the other end pivotably mounted substantially at the midpoint along the other of said shafts.

12. A pressure transfer module as set forth in claim 1 including second valving means for controlling flow of fluid through said pump inlet and outlet ports.

13. A pressure transfer module as set forth in claim 12 wherein said second valving means comprises check valves for unidirectionally controlling said flow of fluid through said pump inlet and outlet ports.

* * * * *